US008733260B2

(12) United States Patent
Takahata et al.

(10) Patent No.: US 8,733,260 B2
(45) Date of Patent: May 27, 2014

(54) EMBROIDERY DATA PROCESSING APPARATUS AND COMPUTER-READABLE MEDIUM STORING EMBROIDERY DATA PROCESSING PROGRAM

(75) Inventors: Hirotsugu Takahata, Nagoya (JP); Harumi Kato, Nagoya (JP); Noriharu Tashiro, Nagoya (JP); Tsuneo Okuyama, Inabe-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 870 days.

(21) Appl. No.: 12/938,851

(22) Filed: Nov. 3, 2010

(65) Prior Publication Data

US 2011/0107950 A1 May 12, 2011

(30) Foreign Application Priority Data

Nov. 10, 2009 (JP) ..... 2009-257191

(51) Int. Cl.
*D05C 3/00* (2006.01)

(52) U.S. Cl.
USPC ..... 112/78

(58) Field of Classification Search
USPC ..... 112/80.23, 78, 102.5, 103, 470.01, 112/470.04, 470.06, 470.09, 260, 475.05, 112/475.19, 275
See application file for complete search history.

(56) References Cited

U.S. PATENT DOCUMENTS

| | | | | |
|---|---|---|---|---|
| 4,444,135 | A * | 4/1984 | Yanagi et al. | 112/470.04 |
| 4,499,838 | A * | 2/1985 | Voza | 112/475.19 |
| 4,742,786 | A * | 5/1988 | Hashimoto et al. | 112/102.5 |
| 4,982,674 | A * | 1/1991 | Hayakawa | 112/102.5 |
| 5,307,749 | A * | 5/1994 | Kaiser | 112/470.04 |
| 5,775,240 | A | 7/1998 | Hara et al. | |
| 7,493,867 | B2 | 2/2009 | Asano | |
| 8,161,895 | B2 * | 4/2012 | Grufman et al. | 112/78 |

FOREIGN PATENT DOCUMENTS

| | | |
|---|---|---|
| JP | A 9-000762 | 1/1997 |
| JP | A 9-000763 | 1/1997 |
| JP | A 9-143856 | 6/1997 |
| JP | A 9-158029 | 6/1997 |
| JP | A 2002-095881 | 4/2002 |
| JP | A 2003-047790 | 2/2003 |
| JP | A 2007-082812 | 4/2007 |

* cited by examiner

*Primary Examiner* — Tejash Patel
(74) *Attorney, Agent, or Firm* — Oliff PLC

(57) ABSTRACT

An embroidery data processing apparatus that processes embroidery data includes a reference point setting unit that sets, within a sewing area, positions of at least three reference points, a reference line setting unit that sets two reference lines being straight lines that intersect each other and each pass through at least two reference points of the at least three reference points, a plane setting unit that sets a reference plane by setting two sets of a plurality of virtual lines arranged in a matrix, a position determination unit that determines the plurality of arrangement positions based on the reference plane, a pattern selection unit that selects a type for the plurality of unit patterns from at least one type of unit pattern, and an arrangement unit that arranges the plurality of unit patterns of the type in the plurality of arrangement positions.

20 Claims, 16 Drawing Sheets

EMBROIDERY DATA PROCESSING APPARATUS AND COMPUTER-READABLE MEDIUM STORING EMBROIDERY DATA PROCESSING PROGRAM

This application claims priority to Japanese Patent Application No. 2009-257191, filed Nov. 10, 2009, the content of which is hereby incorporated herein by reference.

BACKGROUND

The present disclosure relates to an embroidery data processing apparatus and a computer-readable medium that stores an embroidery data processing program that allow a user's desired embroidery pattern to be sewn.

A sewing machine is known that is configured to determine a method of arranging unit patterns in accordance with input by a user and sew an embroidery pattern formed by the unit patterns. In the known sewing machine, for example, the user may set two contour lines such as a circle or a heart shape. A method of arranging unit patterns is determined such that all the unit patterns are within an area defined by the two contour lines. Based on the determined arrangement method, sewing is performed on a work cloth. According to the known sewing machine, it is possible to sew the unit patterns within a shape of the user's desired contour lines.

SUMMARY

Using the known sewing machine, a user can only set a shape of an area in which unit patterns are to be arranged. The user may not be able to appropriately set a distance between the unit patterns, an arrangement of the unit patterns, and so on to cause the sewing machine to sew a desired embroidery pattern. Therefore, an embroidery pattern that can be sewn by the sewing machine may be monotonous.

Various exemplary embodiments of the broad principles derived herein provide an embroidery data processing apparatus and a computer-readable medium that stores an embroidery data processing program that are capable of generating diverse embroidery data sets in which unit patterns are arranged in an arrangement that a user desires.

Exemplary embodiments provide an embroidery data processing apparatus that processes embroidery data for sewing an embroidery pattern including a plurality of unit patterns arranged on a work cloth using a sewing machine that is capable of performing embroidery sewing. The embroidery data processing apparatus includes a reference point setting unit that sets, within a sewing area, positions of at least three reference points to be used to determine a plurality of arrangement positions of the plurality of unit patterns, the sewing area being an area in which sewing can be performed, and a reference line setting unit that sets two reference lines being straight lines that intersect each other and each pass through at least two reference points of the at least three reference points. The embroidery data processing apparatus also includes a plane setting unit that sets a reference plane by setting two sets of a plurality of virtual lines arranged in a matrix. Each set of the plurality of virtual lines is arranged based on a distance between at least two reference points through which one of the two reference lines passes and being parallel to the other of the two reference lines. The reference plane is a plane on which the plurality of unit patterns are to be arranged. The one of the two reference lines is different for each of the two sets of plurality of virtual lines. The embroidery data processing apparatus further includes a position determination unit that determines the plurality of arrangement positions based on the reference plane, a pattern selection unit that selects a type for the plurality of unit patterns from at least one type of unit pattern for which embroidery data is stored in a memory, and an arrangement unit that arranges the plurality of unit patterns of the type selected by the pattern selection unit in the plurality of arrangement positions determined by the position determination unit.

Exemplary embodiments also provide a computer-readable medium storing an embroidery data processing program for processing embroidery data for sewing an embroidery pattern including a plurality of unit patterns arranged on a work cloth. The program comprising instructions that cause a computer to perform the steps of setting, within a sewing area, positions of at least three reference points to be used to determine a plurality of arrangement positions of the plurality of unit patterns, the sewing area being an area in which sewing can be performed, and setting two reference lines being straight lines that intersect each other and each pass through at least two reference points of the at least three reference points. The program also includes instructions that cause the computer to perform the steps of setting a reference plane by setting two sets of a plurality of virtual lines arranged in a matrix. Each set of the plurality of virtual lines is arranged based on a distance between at least two reference points through which one of the two reference lines passes and being parallel to the other of the two reference lines. The reference plane is a plane on which the plurality of unit patterns are to be arranged. The one of the two reference lines is different for each of the two sets of plurality of virtual lines. The program further includes instructions that cause the computer to perform the steps of determining the plurality of arrangement positions based on the reference plane, selecting a type for the plurality of unit patterns from at least one type of unit pattern for which embroidery data is stored in a memory, and arranging the plurality of unit patterns of the selected type in the determined plurality of arrangement positions.

BRIEF DESCRIPTION OF THE DRAWINGS

Exemplary embodiments will be described below in detail with reference to the accompanying drawings in which.

DETAILED DESCRIPTION

Figure 1:
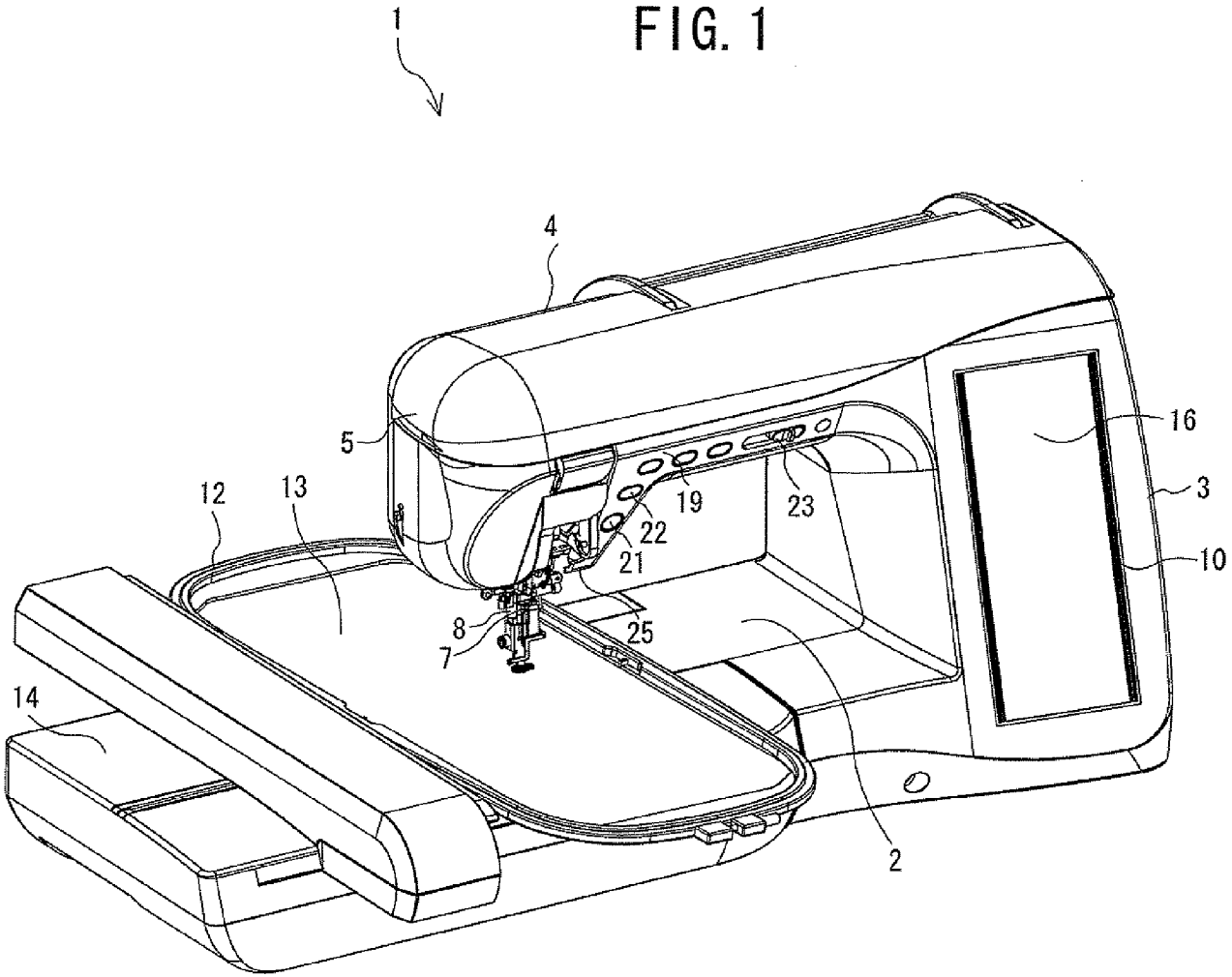
FIG. 1 is an oblique view of an entire sewing machine.

Hereinafter, a sewing machine 1 that is an embodiment of an embroidery data processing apparatus according to the present disclosure will be explained with reference to the drawings. The referenced drawings are used to explain technological features that can be used in the present disclosure. Device configurations, flowcharts of various types of processing, and the like that are shown in the drawings are merely explanatory examples and do not have the effect of limiting the present disclosure only to those examples.

A physical configuration of the sewing machine 1 will be explained with reference to FIG. 1. In FIG. 1, the side on which a user is positioned and the opposite side are respectively the front side and the rear side of the sewing machine 1. The right side and the left side of the sewing machine 1 as seen from the user are respectively the right side and the left side of the sewing machine 1. The sewing machine 1 includes a bed 2, a pillar 3, an arm 4, and a head 5. The bed 2 extends in the left-right direction and supports the sewing machine 1. The pillar 3 extends upward from the right end of the bed 2. The arm 4 extends to the left from the upper end of the pillar 3 such that the arm 4 is opposite to the bed 2. The head 5 is provided on the left end portion of the arm 4. The head 5 is provided with a needle bar 7, a presser bar 8, and the like. A sewing machine motor 79 (refer to FIG. 2), a drive shaft (not shown in the drawings), and a needle bar up-and-down mechanism (not shown in the drawings) are provided in the interior of the sewing machine 1.

An embroidery frame 12 is disposed on the bed 2. The embroidery frame 12 holds in place a work cloth 13. The embroidery frame 12 is moved by an embroidery frame moving mechanism 14 in an X axis direction (the left-right direction of the sewing machine 1) and a Y axis direction (the front-rear direction of the sewing machine 1). In the sewing machine 1, the needle bar 7 and the like are driven while the work cloth 13 is moved by the embroidery frame moving mechanism 14, so that sewing of an embroidery pattern is performed. Operations of the embroidery frame moving mechanism 14, the needle bar 7, and the like are controlled by a CPU 61 (refer to FIG. 2) of the sewing machine 1 based on embroidery data.

A liquid crystal display 10 is provided on a front face of the pillar 3. A touch panel 16 is provided on a surface of the liquid crystal display 10. An embroidery pattern, an input key, and the like may be displayed on the liquid crystal display 10. A user may input one of a desired embroidery pattern and an operating command to the sewing machine 1 by touching a portion of the touch panel 16 that corresponds to the position where the one of the embroidery pattern and the input key is displayed on the liquid crystal display 10. An image that is captured by an image sensor 50 that will be described below may be displayed on the liquid crystal display 10. By operating the touch panel 16 using a stylus pen (not shown in the drawings) or the like, the user may specify a position of a reference point and an area in which an embroidery pattern will be sewn, which will be explained below. A card slot 17 (refer to FIG. 2) is provided at the right side face of the pillar 3. A memory card 70 may be inserted into the card slot 17.

A thread spool (not shown in the drawings) that are used in sewing and the like may be provided in the arm 4. A front cover 19 is provided on the front faces of the arm 4 and the head 5. A plurality of operation switches such as a sewing start/stop switch 21, a reverse stitch switch 22, and the like are provided on the front cover 19. The sewing start/stop switch 21 is used for issuing a command to start or stop the sewing. The reverse stitch switch 22 is used for feeding a cloth from the rear toward the front, which is the opposite of the normal feed direction. A speed controller 23 is also provided on the front cover 19. The speed controller 23 is used for adjusting a sewing speed (a revolution speed of the drive shaft). The image sensor 50 (refer to FIG. 2) is disposed at a lower left portion 25 inside the front cover 19.

The image sensor 50 is a known CMOS image sensor and may capture an image. The image sensor 50 is provided such that the image sensor 50 faces downward. The image sensor 50 is capable of capturing an image of an area that includes a needle drop point. The needle drop point is a point at which a needle (not shown in the drawings) that is attached to the needle bar 7 pierces the work cloth 13. The image sensor 50 may be one of a CCD camera and another image capturing element.

Figure 2:
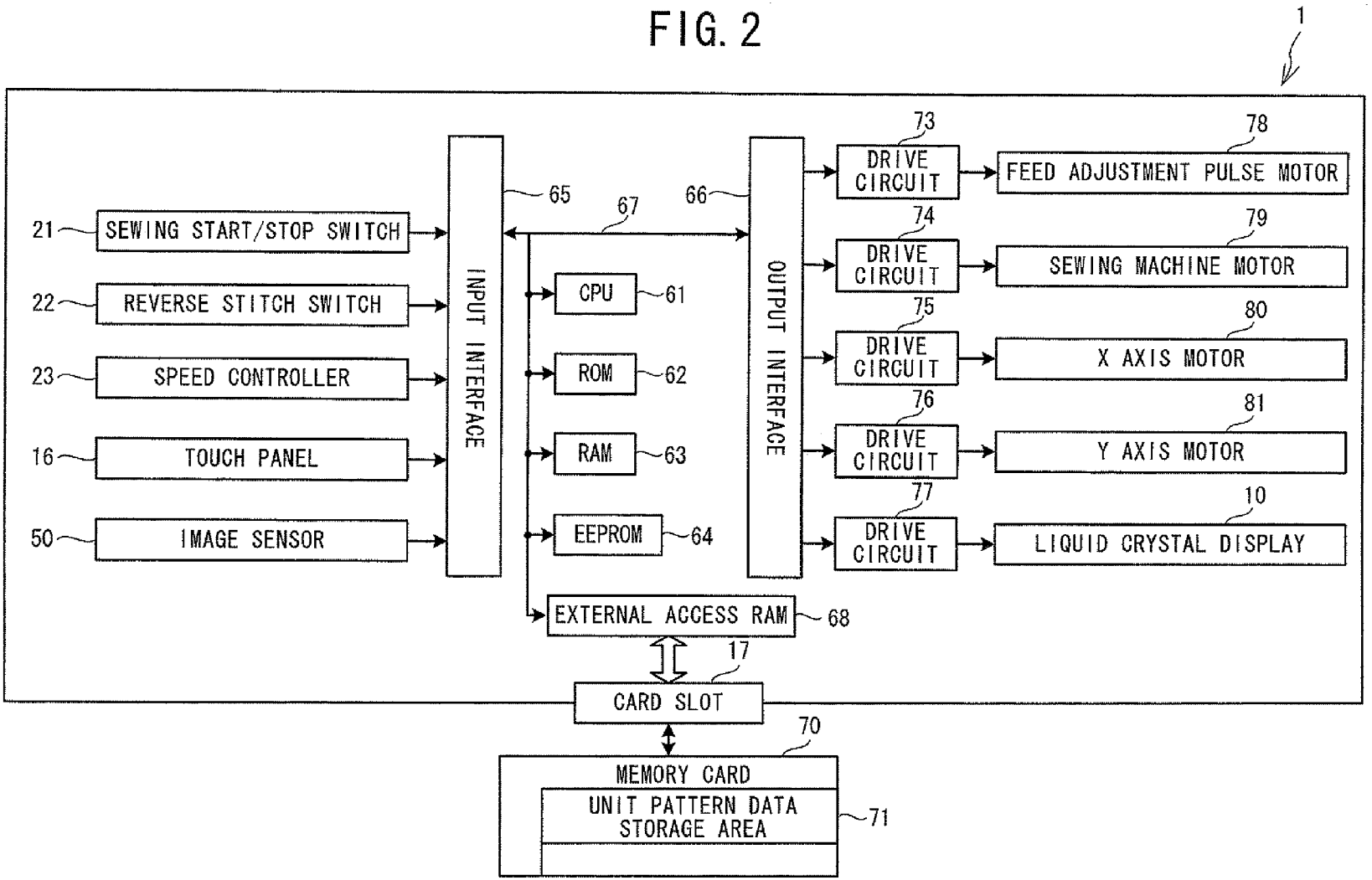
FIG. 2 is a block diagram that shows an electrical configuration of the sewing machine.

The main electrical configuration of the sewing machine 1 will be explained with reference to FIG. 2. The sewing machine 1 includes the CPU 61, a ROM 62, a RAM 63, an EEPROM 64, the card slot 17, an external access RAM 68, an input interface 65, an output interface 66, and the like, which are connected to one another via a bus 67.

The CPU 61 performs various types of computations and processing in accordance with a control program and performs control over the sewing machine 1. The ROM 62 is a read-only storage element. The ROM 62 stores the control program and the like. The RAM 63 is a storage element that can be read from and written to as desired. The RAM 63 temporarily stores various types of data such as data for an image captured by the image sensor 50, computational results, and the like. The EEPROM 64 is a non-volatile memory. The EEPROM 64 stores various types of data including image data for a message, an operation key, and the like that are displayed on the liquid crystal display 10. The external access RAM 68 reads various types of data such as embroidery data of a unit pattern and the like from the memory card 70 that is connected to the card slot 17. In the present embodiment, the memory card 70 that is connected to the external access RAM 68 may include a unit pattern data storage area 71. The unit pattern data storage area 71 stores various types of data that are related to a plurality of types of unit patterns. In the sewing machine 1, it is possible to generate diverse embroidery data sets by arranging the unit patterns with regularity in accordance with a command from the user.

The sewing start/stop switch 21, the reverse stitch switch 22, the speed controller 23, the touch panel 16, the image sensor 50, and the like are connected to the input interface 65. Drive circuits 73 to 77 are electrically connected to the output interface 66. The drive circuit 73 drives a feed adjustment pulse motor 78. The feed adjustment pulse motor 78 adjusts a distance by which the cloth is fed by a feed dog (not shown in the drawings). The drive circuit 74 drives a sewing machine motor 79, which rotates the drive shaft. The drive circuits 75 and 76 respectively drive an X axis motor 80 and a Y axis motor 81. The X axis motor 80 and the Y axis motor 81 respectively move the embroidery frame 12 in the X axis direction and in the Y axis direction. The drive circuit 77 drives the liquid crystal display 10.

Processing performed by the sewing machine 1 according to the present embodiment will be explained with reference to FIGS. 3 to 16. The CPU 61 performs the processing described below in accordance with a program stored in the ROM 62. In the sewing machine 1, embroidery data that is desired by the user is generated by arranging, with regularity, unit patterns whose type is selected by the user in accordance with a command from the user.

The sewing machine 1 may perform first data generating processing and second data generating processing to generate the embroidery data. In the first data generating processing, the embroidery data is generated based on two reference lines that intersect with each other and on positions of a plurality of reference points located on the reference lines. In the second data generating processing, the embroidery data is generated based on a shape of a parallelogram that is determined by three reference points. The user may operate the touch panel 16 or the like to issue a command to the sewing machine 1 to perform one the first data generating processing and the second data generating processing.

When the reference lines, which are used as references in generating the embroidery data, are set in the first data generating processing, the sewing machine 1 may perform one of first reference line setting processing and second reference line setting processing. In the first reference line setting processing, the user may operate the touch panel 16 to set the reference lines in the sewing machine 1. In the second reference line setting processing, the user may set the reference lines in the sewing machine 1 by specifying points on the work cloth 13 and causing the image sensor 50 to capture an image of the points. The user may issue a command to the sewing machine 1 to perform one the first reference line setting processing and the second reference line setting processing. The reference lines are virtually used as references to generate the embroidery data. In actuality, the reference lines are not drawn on the work cloth 13.

Hereinafter, the first data generating processing will be explained. When a command is issued to the sewing machine 1 to perform the first data generating processing, the CPU 61 starts the first data generating processing shown in FIG. 3. In the first data generating processing, first, an image of the work cloth 13 is captured by the image sensor 50 (step S1). A reference line setting screen is displayed on the liquid crystal display 10 (step S2). The reference line setting screen includes the captured image of the work cloth 13. Next, the reference line setting processing is performed (one of steps S3 and S50). An explanation follows of a case in which a command is issued to perform the first reference line setting processing (step S3).

Figure 4:
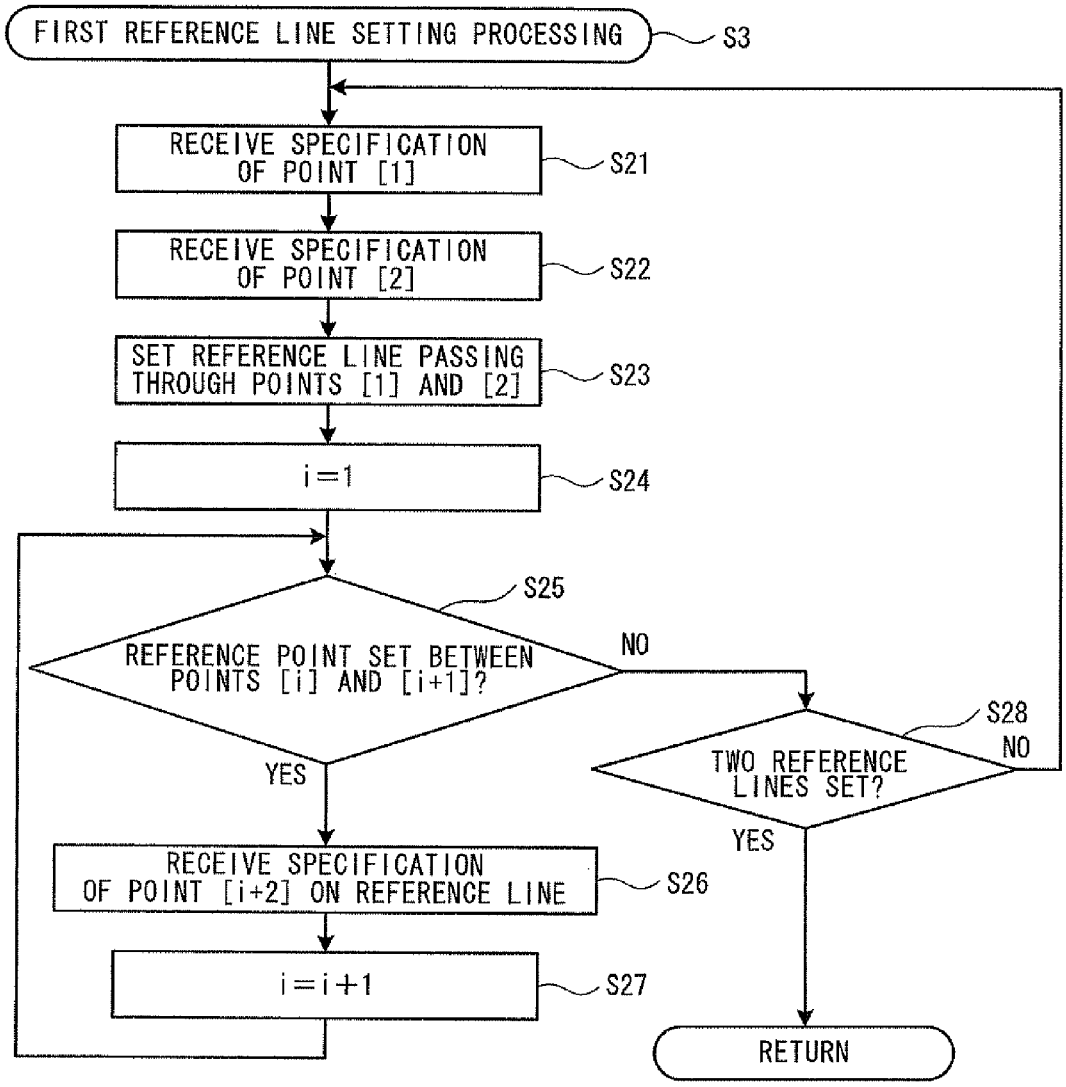
FIG. 4 is a flowchart of first reference line setting processing performed in the first data generating processing.

As shown in FIG. 4, when the first reference line setting processing is started (step S3), specifications of positions of points [1] and [2] are received (steps S21 and S22). The points [1] and [2] are reference points that are used to set the reference lines. The user may operate the touch panel 16 while viewing the liquid crystal display 10 to specify a reference point at a desired position on the captured image of the work cloth 13. When the positions of the two reference points are specified, a reference line that is a virtual straight line that passes through the points [1] and [2] is set and displayed on the liquid crystal display 10 (step S23).

A counter i, which indicates a reference point number, is set to 1 (step S24). A determination is made as to whether an operation has been performed to set a reference point between points [i] and [i+1] (step S25). In a case where the user has performed an operation to additionally set a reference point (YES at step S25), a specification of a position of a point [i+2] is accepted only when the point [i+2] is between the points [i] and [i+1] on the reference line (step S26). The counter i is increased by 1 (step S27), and then the processing returns to the determination at step S25. When no operation has been performed to set a reference point and an operation has been performed to terminate the setting of the reference point (NO at step S25), a determination is made as to whether two reference lines that intersect with each other have been set (step S28). If the two reference lines have not been set (NO at step S28), the processing returns to step S21. Then, the processing is performed to set the next reference line.

Figure 5:
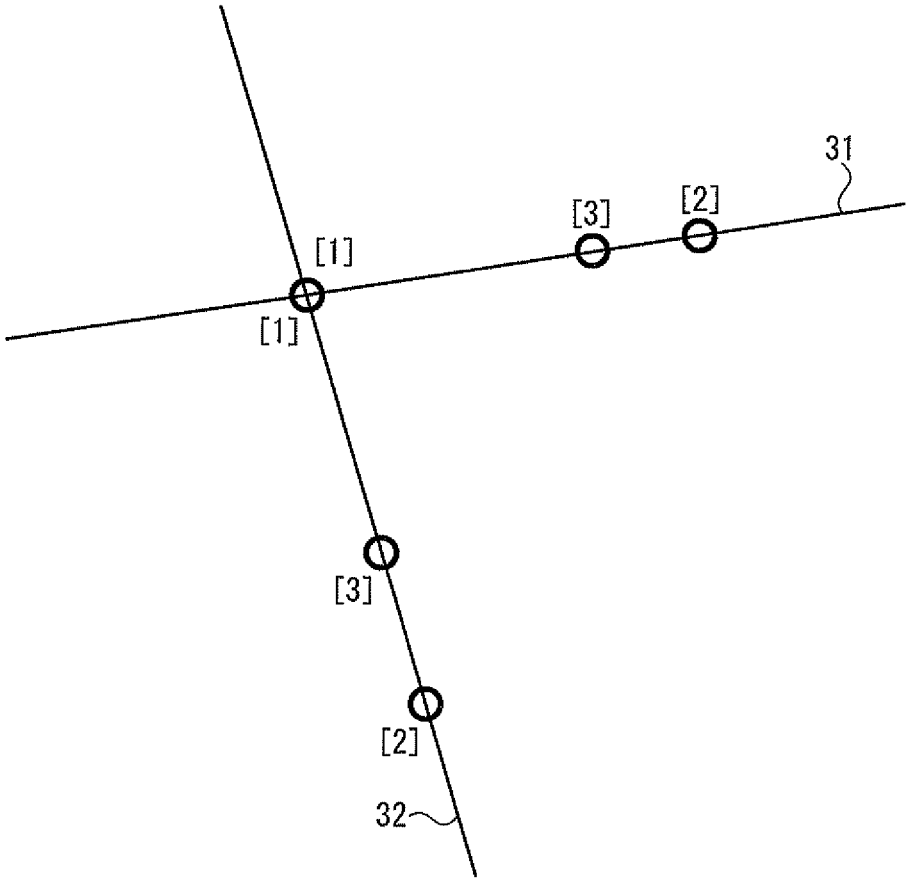
FIG. 5 is a figure that shows an example of reference points and reference lines which are set in the first reference line setting processing.

FIG. 5 shows an example in which reference points and reference lines 31 and 32 are set by the first reference line setting processing. In order to set the first reference line 31, which is one of the two reference lines, the user specifies the point [1] (step S21) and the point [2] (step S22). The first reference line 31, which passes through the points [1] and [2], is set (step S23). In a case where the user performs the operation to additionally set a reference point (YES at step S25), the CPU 61 accepts a specification of a point [3] only when the point [3] is between the points [1] and [2] on the first reference line 31 (step S26). Next, the processing is performed for the second reference line 32 in the same manner (NO at step S28, steps S21 to S27). In the example shown in FIG. 5, the point [1] on the first reference line 31 and the point [1] on the second reference line 32 are specified as a common reference point of the two reference lines. However, the reference points on the two reference lines may be separately specified.

Figure 3:
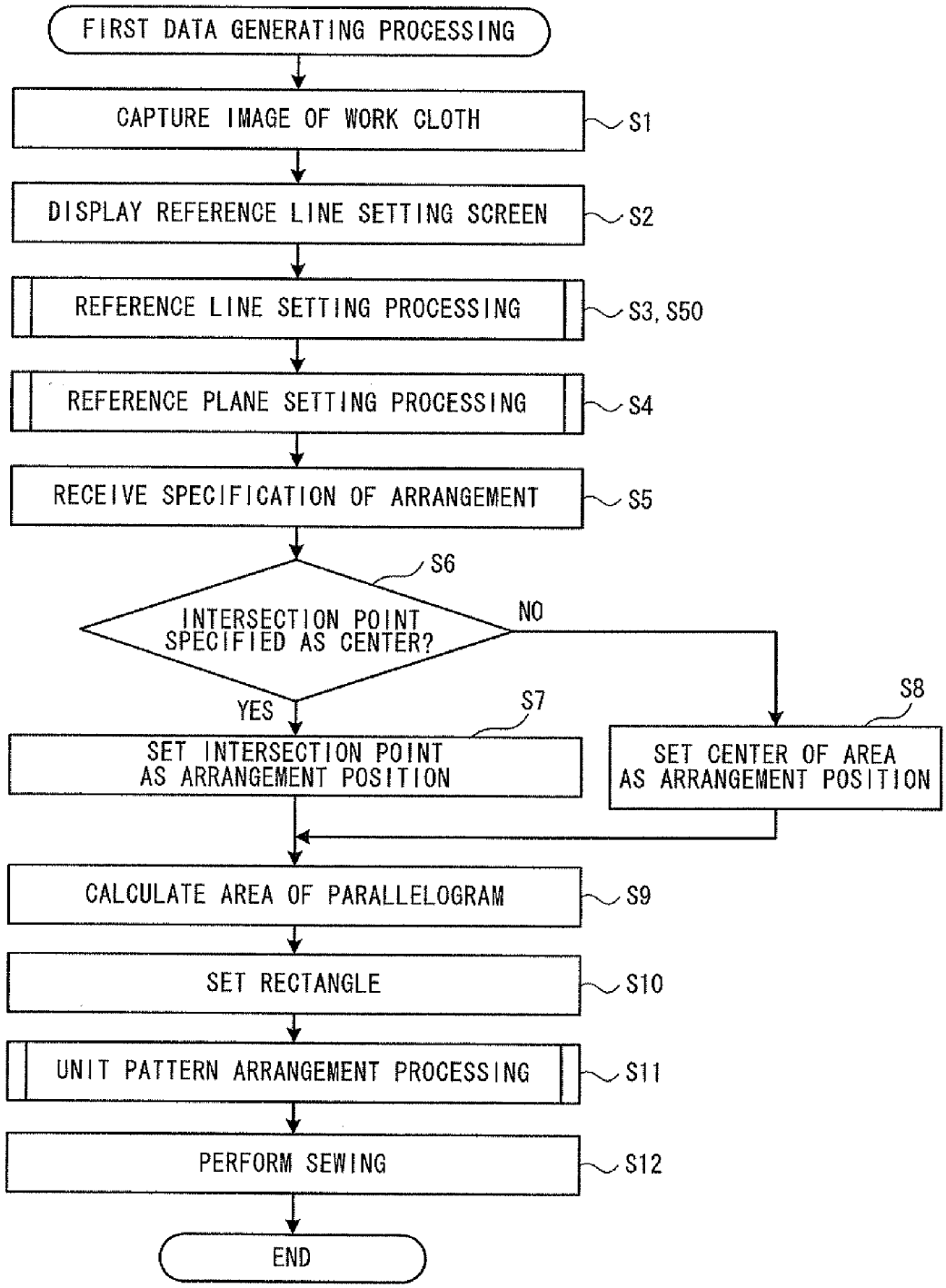
FIG. 3 is a flowchart of first data generating processing performed by the sewing machine.

In a case where the two intersecting reference lines has been set (YES at step S28 in FIG. 4), the processing returns to the first data generating processing (refer to FIG. 3). Reference plane setting processing is then performed (step S4).

Figure 6:
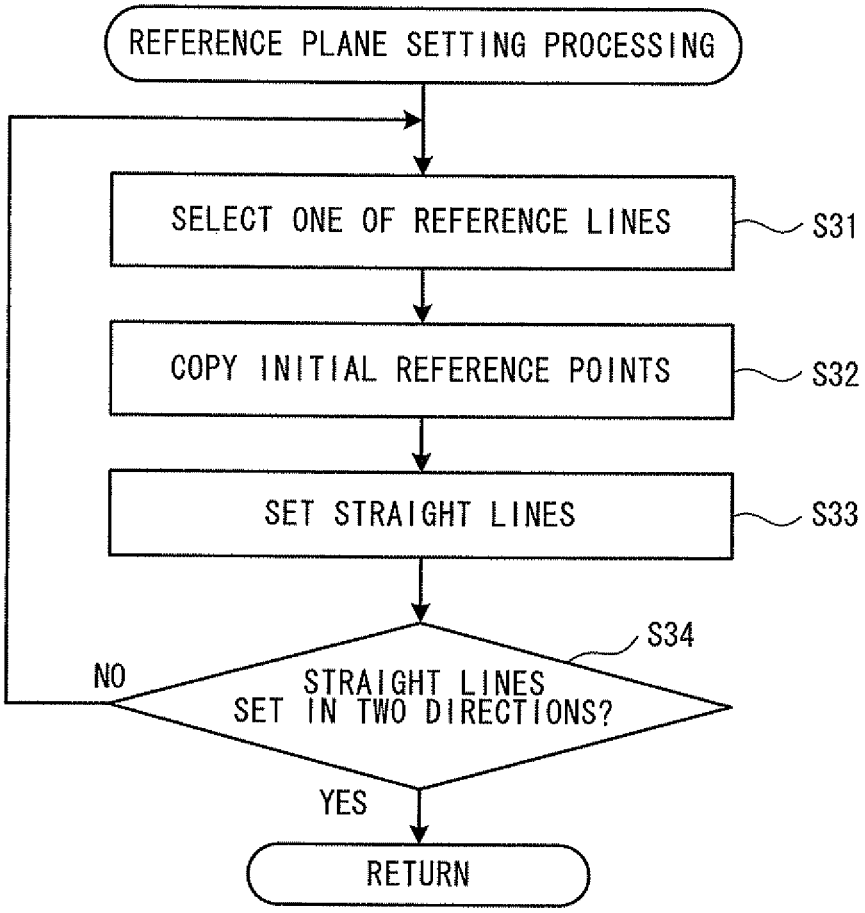
FIG. 6 is a flowchart of reference plane setting processing that is performed in the first data generating processing.
Figure 7:
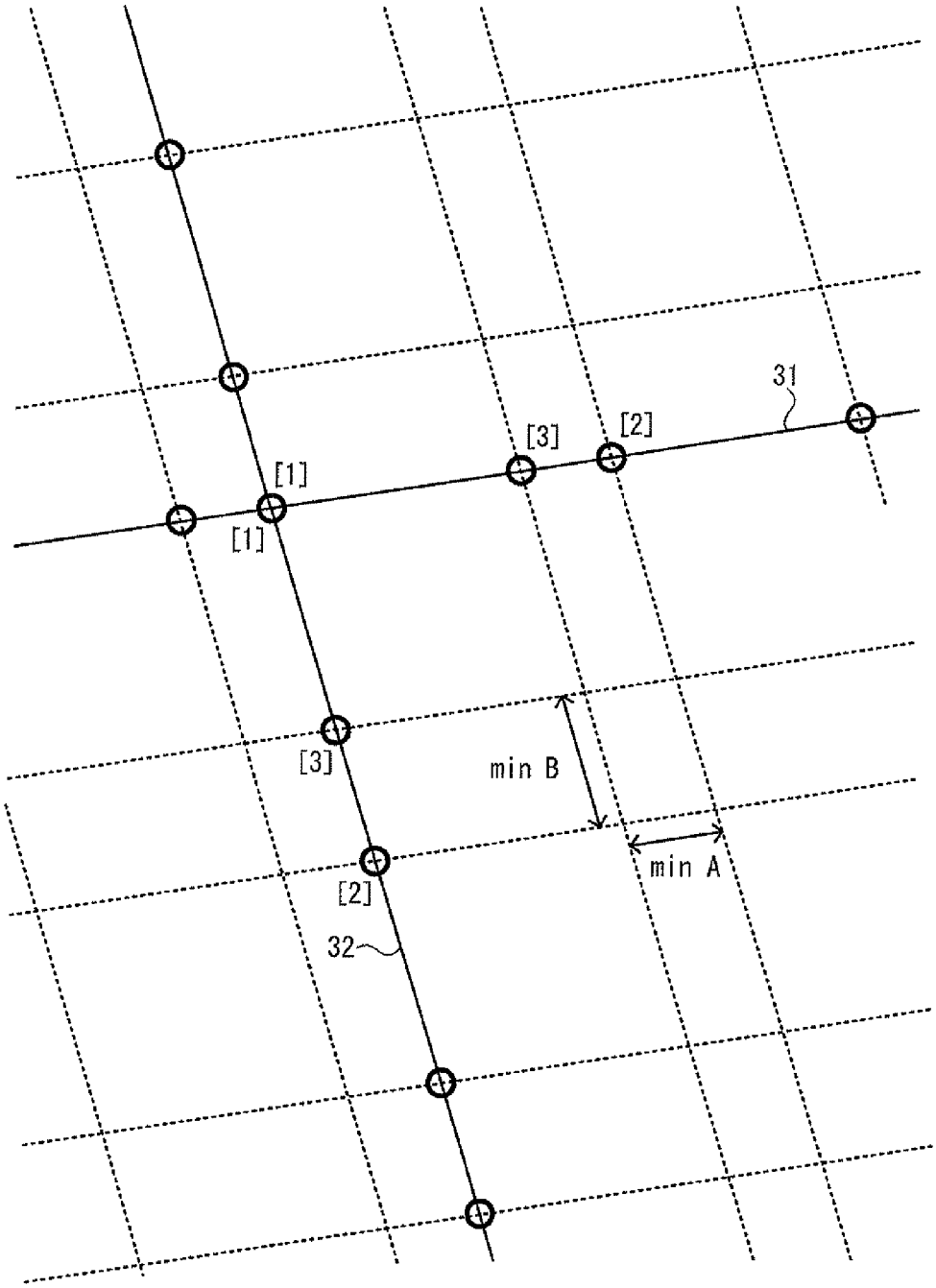
FIG. 7 is a figure that shows an example of a reference plane which is set by the reference plane setting processing.

As shown in FIG. 6, when the reference plane setting processing is started, one of the two set reference lines is selected (step S31). The two or more reference points (hereinafter referred to as "initial reference points"), which have been set on the selected reference line in the first reference line setting processing, form one unit from the reference point on one end to the reference point on the other end. The one unit is repeatedly copied on the selected reference line with regularity (step S32). As shown in FIG. 7, in the present embodiment, one unit is from the point [1] on one end to the point [2] on the other end. The reference points [1], [3], and [2] are copied on the reference line such that the point [1] of one of the two adjacent units overlaps with the point [2] of the other unit. The copied reference points are hereinafter referred to as "virtual reference points". Next, straight lines are set that respectively pass through the initial reference points and the virtual reference points on the selected reference line and that are parallel to the other reference line (step S33). A determination is made as to whether the setting of the straight lines for the reference lines in two intersecting directions has been completed (step S34). If the setting of the straight lines has not been completed (NO at step S34), the other reference line is selected and straight lines are set (step S31 to step S33). As a result, as shown in FIG. 7, a matrix reference plane is set that is formed of a plurality of arranged parallelograms. If the setting of the straight lines in the two directions has been completed (YES at step S34), the processing returns to the first data generating processing (refer to FIG. 3).

As shown in FIG. 3, when the reference plane setting processing (step S4) is ended, a specification of an arrangement of the unit patterns is received (step S5). In the present embodiment, the user may select one of two arrangement options. One of the options (first arrangement) is to arrange the unit patterns such that centers of the unit patterns are positioned on the intersection points of the straight lines on the reference plane. The other of the options (second arrangement) is to arrange the unit patterns such that the straight lines define boundaries of the unit patterns. In a case where the first arrangement is selected (YES at step S6), the intersection points are set and determined as arrangement positions of the centers of the unit patterns (step S7). In a case where the second arrangement is selected (NO at step S6), the centers of areas of parallelograms defined by the straight lines are set and determined as the arrangement positions of the centers of the unit patterns (step S8).

An area of a parallelogram is calculated that has two pairs of opposite sides that are respectively parallel to the reference lines 31 and 32 and in which a length of the opposite sides in each of the pairs is a shortest distance between the reference points on each of the reference lines (step S9). In the example shown in FIG. 7, the shortest distance between the reference points on the first reference line 31 is minA, and the shortest distance between the reference points on the second reference line 32 is minB. Therefore, the area of the parallelogram is calculated in which minA and minB are lengths of the opposite sides in the respective pairs.

Figure 8:
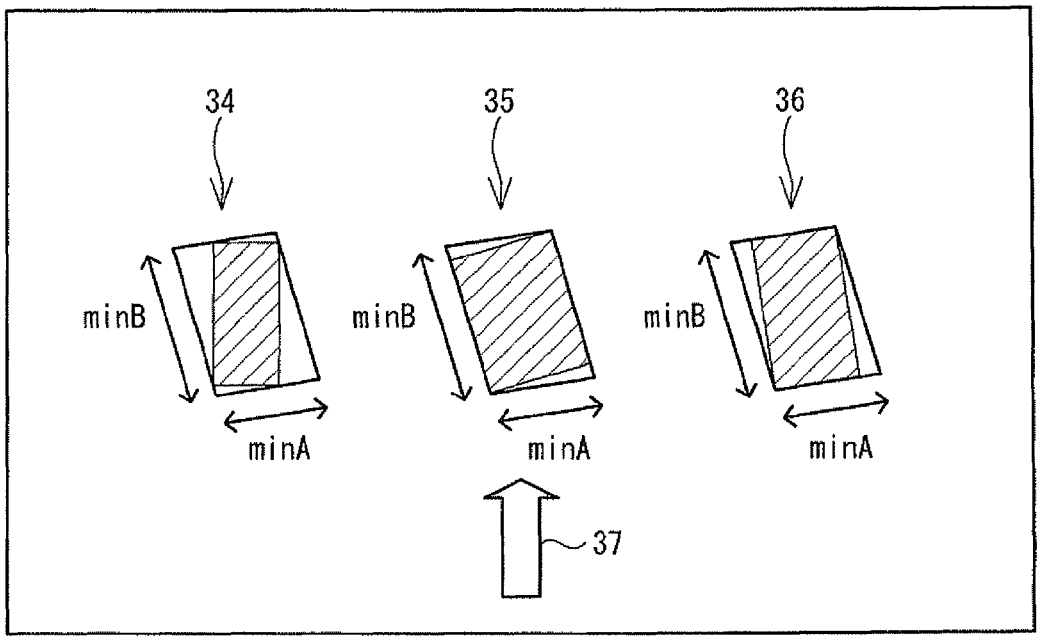
FIG. 8 is a figure that shows an example of options for an area in which a unit pattern will be sewn.

Rectangular areas are determined that fit into the calculated area of the parallelogram. One of the determined rectangular areas is set as an area in which the unit pattern will be sewn (step S10). Specifically, the size of one of the rectangular areas is the size of each of the unit patterns to be sewn. In the present embodiment, as shown in FIG. 8, a plurality of rectangles 34 to 36 that fit into the area of the parallelogram are determined and displayed on the liquid crystal display 10 as options for an area in which the unit pattern will be sewn. The rectangle 34 is the largest rectangle whose vertices internally contact the parallelogram among the rectangles that have sides parallel to the left-right direction of the liquid crystal display 10. The rectangle 35 is the largest rectangle whose two sides overlap with the sides whose length is minB. The rectangle 36 is the largest rectangle whose two sides overlap with the sides whose length is minA. While viewing an arrow 37 displayed on the liquid crystal display 10, the user may operate the touch panel 16 to select a desired rectangle. Further, the user may select which direction will be the upper direction of the unit pattern. The CPU 61 sets the selected rectangle as the area in which the unit pattern will be sewn. The CPU 61 sets the selected direction as the upper direction of the unit pattern. As shown in FIG. 3, when the area on which the unit pattern will be sewn (step S10) is set, unit pattern arrangement processing is performed (step S11).

Figure 9:
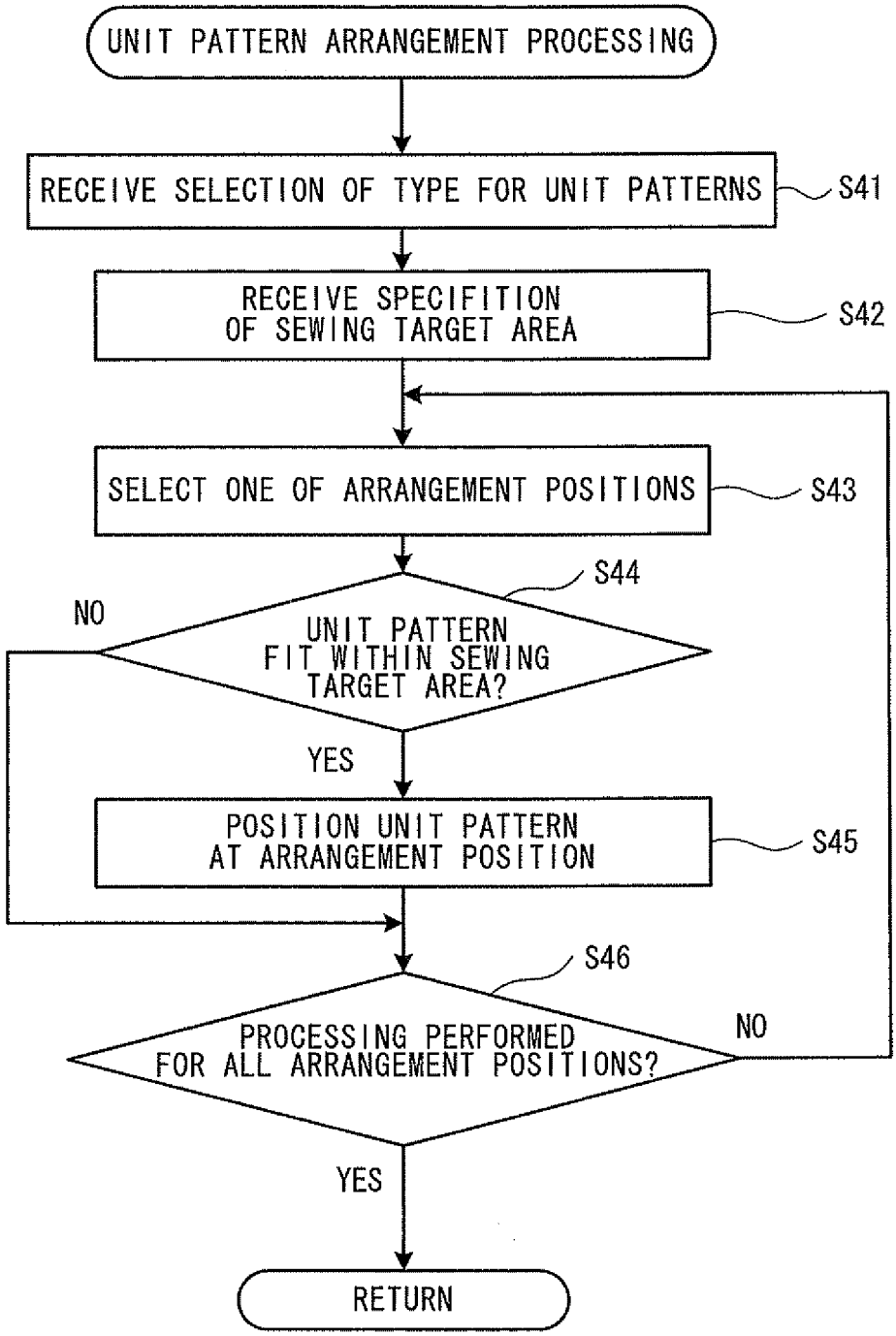
FIG. 9 is a flowchart of unit pattern arrangement processing that is performed in the first data generating processing.

As shown in FIG. 9, when the unit pattern arrangement processing is started, an selection of a type for the unit patterns is received (step S41). Specifically, an image of at least one type of unit pattern that is stored in the unit pattern data storage area 71 (refer to FIG. 2) of the memory card 70 is displayed on the liquid crystal display 10. The user may operate the touch panel 16 to select a type for the unit patterns from the at least one type of unit pattern. The CPU 61 sets the selected type as a type for the unit patterns that will form an embroidery pattern. Next, a specification of the sewing target area is received (step S42). Specifically, a captured image of the work cloth 13 is displayed on the liquid crystal display 10. The user may operate the touch panel 16 to specify a sewing target area 38 (refer to FIGS. 10 and 11) on the work cloth 13. The sewing target area 38 is an area in which the unit patterns will be sewn. The CPU 61 causes the specified sewing target area 38 to be displayed on the liquid crystal display 10.

One of the arrangement positions that is within the sewing target area 38 is selected from among the arrangement positions in the arrangement set in the processing at one of steps S7 and S8, (step S43). A determination is made as to whether a unit pattern fits inside the sewing target area 38 in a case where the unit pattern is positioned in the selected arrangement position (step S44). If the unit pattern does not fit inside the sewing target area 38, namely, if the unit pattern to be positioned overlaps with a boundary of the sewing target area 38 (NO at step S44), the processing directly shifts to the next determination (step S46). If the unit pattern fits inside the sewing target area 38 (YES at step S44), the unit pattern is positioned in the selected arrangement position (step S45). Next, a determination is made as to whether the processing at steps S44 and S45 has been performed for all the arrangement positions within the sewing target area 38 (step S46). If the processing at steps S44 and S45 has not been performed for all the arrangement positions (NO at step S46), the processing returns to step S43. If the processing at steps S44 and S45 has been performed for all the arrangement positions (YES at step S46), the processing returns to the first data generating processing (refer to FIG. 3). As shown in FIG. 3, after the unit pattern arrangement processing (step S11) is ended, the embroidery pattern is sewn within the sewing target area 38 set on the work cloth 13 based on the generated embroidery data (step S12). Then, the processing ends.

Figure 10:
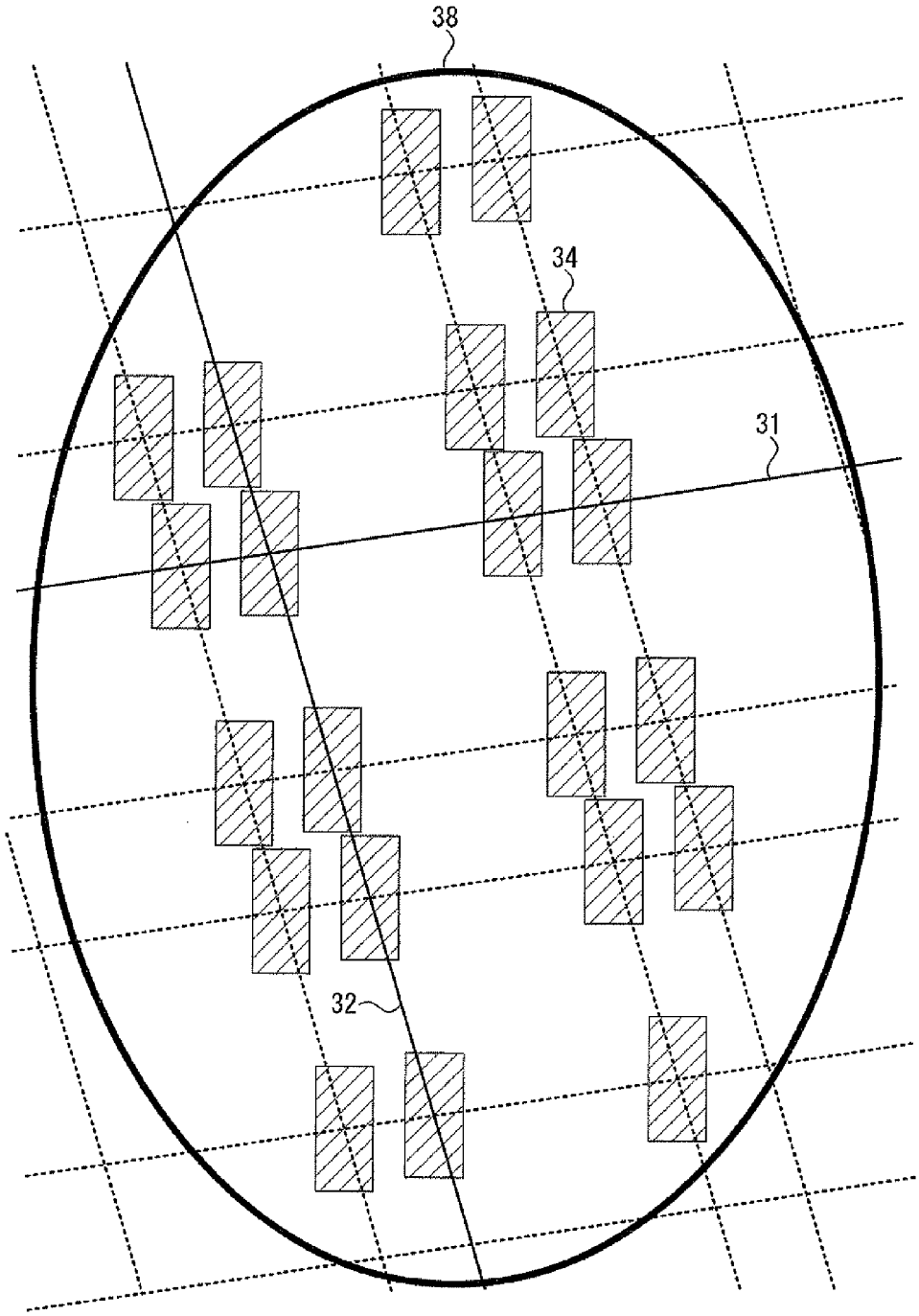
FIG. 10 is a figure that shows an example of a case where intersection points of straight lines are set as arrangement positions of centers of the unit patterns.

An example of the first arrangement, in which the intersection points of the straight lines are set as the arrangement positions of the centers of the unit patterns, will be explained with reference to FIG. 10. In the example, of the three rectangles 34 to 36 (refer to FIG. 8), the rectangle 34 is set as the area in which the unit pattern will be sewn (step S10). In this case, one of the unit patterns that fits within the rectangle 34 is positioned on one of the intersection points of the straight lines within the sewing target area 38 only when the entire rectangle 34 fits inside the sewing target area 38 (YES at step S44, step S45). Accordingly, it is possible to appropriately sew the user's desired embroidery pattern in the sewing target area 38. By changing a position of a reference point set by the user, some of the positions of the intersection points of the straight lines are changed, and thus the arrangement positions of the centers of the unit patterns are changed. Accordingly, the user may cause the sewing machine 1 to generate a desired embroidery pattern by appropriately setting the position of the reference point.

Figure 11:
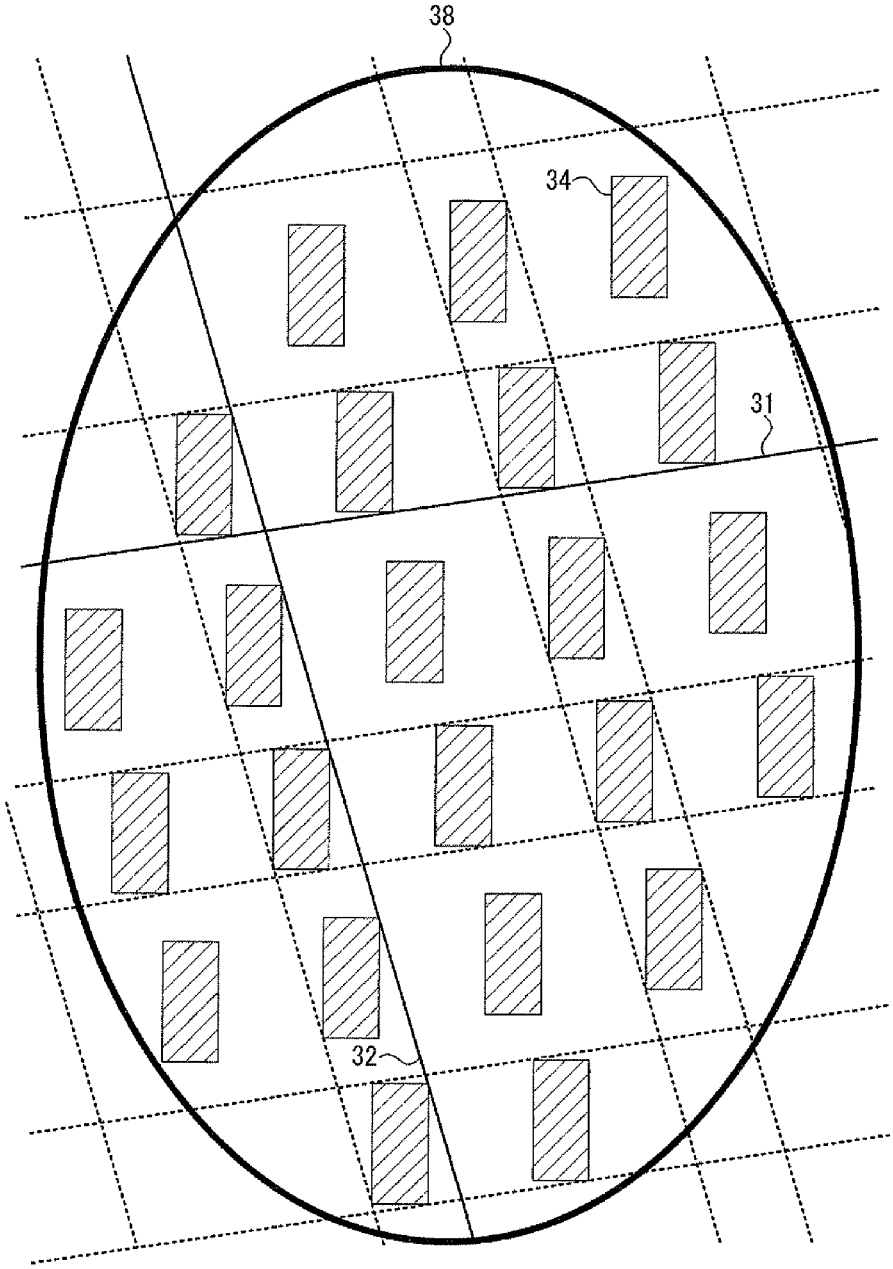
FIG. 11 is a figure that shows an example of a case where the straight lines are set as boundaries of the unit patterns.

An example of the second arrangement, in which the straight lines are set as the boundaries of the unit patterns, will be explained with reference to FIG. 11. In this case, the centers of the parallelograms formed by the straight lines are determined as the arrangement positions of the centers of the unit patterns. In the present embodiment, straight lines that pass in the middle of adjacent straight lines are newly determined on the reference plane, and intersection points of the newly determined lines are set as the arrangement positions. However, an intersection point of diagonal lines of the parallelogram may be determined as one of the arrangement positions. Similarly to the case shown in FIG. 10, by appropriately setting a position of a reference point, the user may cause the sewing machine 1 to sew diverse embroidery patterns. Further, as shown in FIGS. 10 and 11, the user may cause the sewing machine 1 to create a different embroidery pattern by selecting one of the first and second arrangements as described above.

As described above, the positions of at least three reference points are set in the sewing machine 1 of the present embodiment. Based on the positions of the set reference points, the two mutually intersecting reference lines 31 and 32 are set.

Based on the distance between the reference points through which the reference lines 31 and 32 pass, a plurality of straight lines that run parallel to the reference lines 31 and 32 respectively are set. In this way, a reference plane on which the straight lines are arranged in a matrix is set. In the sewing machine 1, arrangement positions of the plurality of unit patterns are determined based on the set reference plane. The embroidery data is generated by positioning the selected type of unit patterns at the determined arrangement positions. As a result, in the sewing machine 1, it is possible to generate a variety of embroidery data in which, according to the positions of the set reference points, a distance between the unit patterns to be sewn, the arrangement of the unit patterns, etc. are different. It is possible to sew the plurality of unit patterns that are arranged in a user's desired arrangement on the work cloth 13.

Specifically, the user may freely set the distance between the unit patterns by varying the setting of the reference points. The arrangement of the unit patterns may be freely set. In addition, the angle at which the reference lines intersect may be freely set. As a result, the user may cause the sewing machine 1 to perform sewing of a desired variety of patterns.

In the sewing machine 1, the positions of the reference points are set in accordance with the operation of the touch panel 16 such that each of the set plurality of reference points is passed through by at least one of the two reference lines 31 and 32. Therefore, in the sewing machine 1, even when four or more reference points are set, the reference plane may be easily and accurately set based on the set reference points, and the embroidery data may be generated.

In the sewing machine 1, the intersection points of the straight lines on the reference plane may be determined as the arrangement positions of the centers of the unit patterns. In this case, the set reference points are set as the centers of the unit patterns, and the unit patterns are arranged with regularity. As a result, the user may easily ascertain the positions at which the unit patterns will be arranged and cause the sewing machine 1 to generate an embroidery data. Further, in the sewing machine 1, the straight lines on the reference plane may be set as the boundaries of the areas in which the unit patterns will be arranged, and the arrangement position of the unit patterns are thus determined. In this case, the user may accurately ascertain the boundaries of the areas in which the unit patterns will be arranged and cause the sewing machine 1 to generate an embroidery data.

In the sewing machine 1, the unit patterns may be arranged such that all the unit patterns fit inside the sewing target area 38 that has been set by the user. As a consequence, it is possible to generate embroidery data that suits the sewing target area 38, outside which the embroidery pattern will not extend. In addition, when the user has issued a command to the sewing machine 1 to perform the first reference line setting processing, by operating the touch panel 16 while viewing the work cloth 13 displayed on the liquid crystal display 10, the user may set the reference points at appropriate positions on the work cloth 13 as required. Furthermore, in the sewing machine 1, it is possible to perform sewing, based on the generated embroidery data, at an appropriate position on the sewing area of the work cloth 13 whose image has been captured by the image sensor 50. After the embroidery data has been generated, it is not necessary for the user to perform an operation such as adjusting the position of the work cloth 13 etc.

Next, processing will be explained in a case where a command is issued to perform the second reference line setting processing. In the second reference line setting processing, the user may specify in advance three or more points in desired positions on the work cloth 13, and use the embroidery frame 12 to set the work cloth 13 to the sewing machine 1 (refer to FIG. 1). When the command is issued to perform the second reference line setting processing, the CPU 61 of the sewing machine 1 performs the second reference line setting processing (step S50) (refer to FIG. 12) after capturing an image of the work cloth 13 (step S1) and displaying the reference line setting screen (step S2), as shown in FIG. 3.

Figure 12:
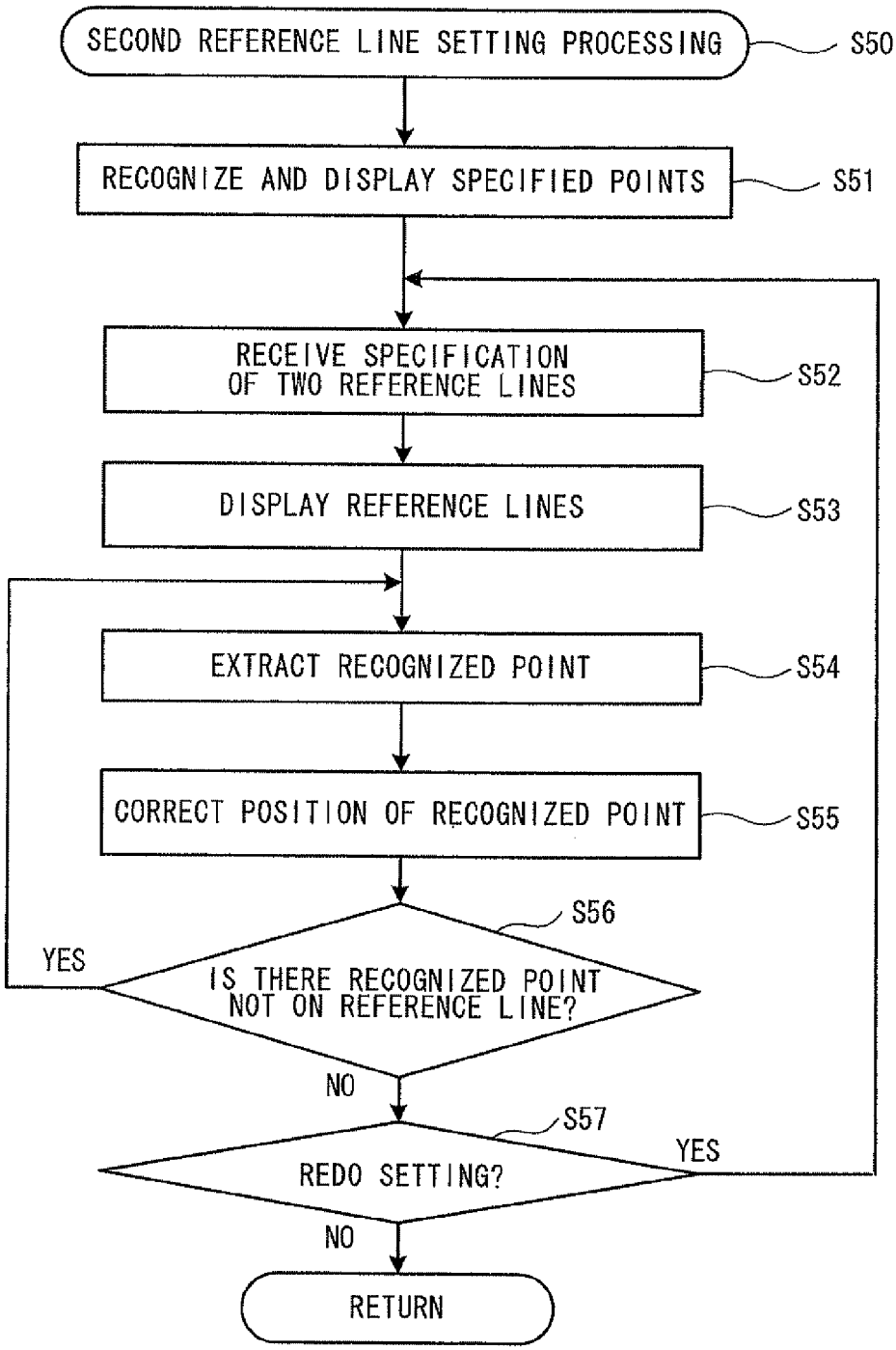
FIG. 12 is a flowchart of second reference line setting processing that is performed in the first data generating processing.
Figure 13:
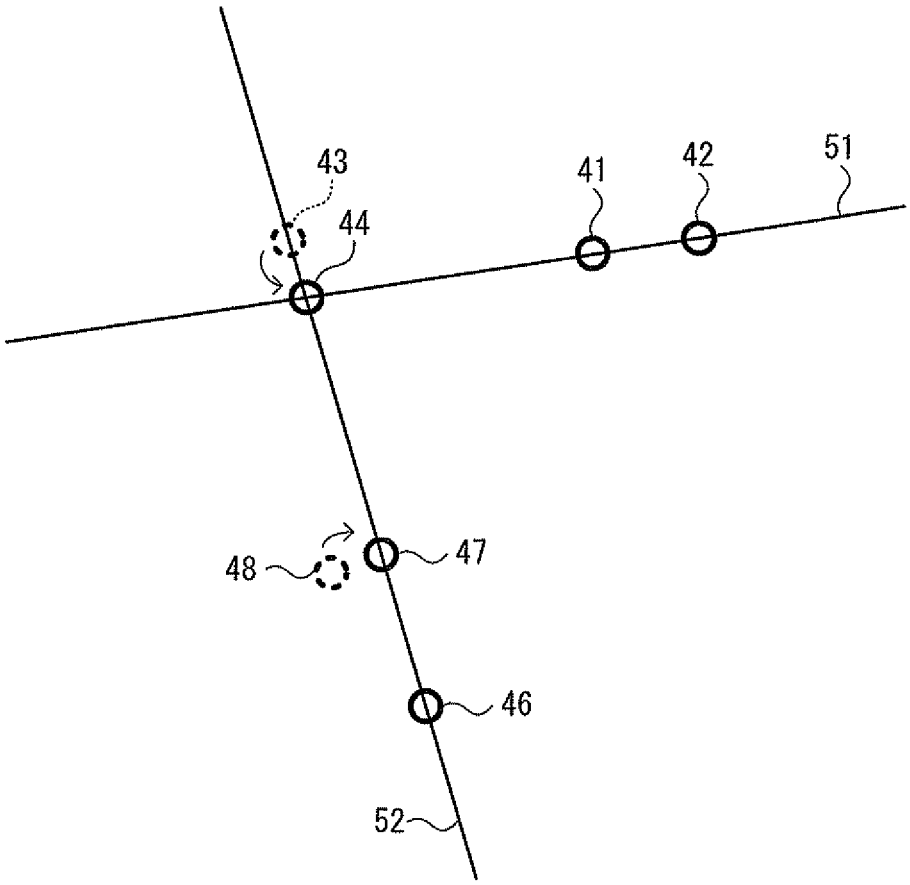
FIG. 13 is a figure that shows an example of reference points and reference lines that are set by the second reference line setting processing.

As shown in FIG. 12, when the second reference line setting processing is started (step S50), known image processing is performed on the captured image of the work cloth 13. As a result of the image processing, the positions of the points specified on the work cloth 13 are recognized, and the captured image and the recognized points are displayed on the liquid crystal display 10 (step S51). The points that are specified on the work cloth 13 and whose positions are recognized are hereinafter referred to as "recognized points". The positions of the recognized points are set as the positions of the reference points. Next, specifications of the two reference lines are received (step S52). By selecting two of the three or more recognized points, the user may specify each one of the reference lines, which is a straight line passing through the two selected recognized points. In the example shown in FIG. 13, a first reference line 51 is specified by selecting recognized points 41 and 42. A second reference line 52 is specified by selecting recognized points 43 and 46.

Next, the specified reference lines 51 and 52 are displayed on the liquid crystal display 10 (step S53). One of a recognized point that is not positioned on either the reference line 51 or 52 and a recognized point that has been selected by the user to have its position corrected is extracted (step S54). A position of the extracted recognized point is corrected to be on one of the reference lines (step S55). In the example shown in FIG. 13, neither the reference line 51 nor the reference line 52 passes through the recognized point 48. As a result, the CPU 61 moves the recognized point 48 perpendicularly to the second reference line 52, which is the reference line closer to the recognized point 48, and corrects the position of the recognized point 48 to be on the second reference line 52. In the example shown in FIG. 13, the user may have selected the recognized point 43, which is on the second reference line 52, to move to the intersection point of the two reference lines 51 and 52. In accordance with operation of the touch panel 16 by the user, the CPU 61 may move the recognized point 43 to the intersection point of the two reference lines 51 and 52.

Next, a determination is made as to whether there is a recognized point that is not on either the reference line 51 or 52 (step S56). If the recognized point exists that is not on either the reference line 51 or 52 (YES at step S56), the processing returns to step S54. Then, the position of the recognized point is corrected to be on one of the reference lines (steps S54 and S55). If no recognized point exists that is not on either the reference line 51 or 52 (NO at step S56), a determination is made as to whether a command has been given to redo the setting of the reference lines (step S57). If there is a command to redo the setting of the reference lines (YES at step S57), the processing returns to step S52. If there is a command to complete the setting of the reference lines (NO at step S57), the positions of the recognized points at that point in time are determined as the positions of the reference points. Then, the processing returns to the first data generating processing (refer to FIG. 3). Further processing is the same as the processing after the end of the above-described first reference line setting processing, and a further explanation is thus omitted here.

As described above, when the user issued a command to the sewing machine 1 to perform the second reference line setting processing, points may be specified on the work cloth 13 and an image of the specified points may be captured by the image sensor 50. In this way, the reference points may be easily set at appropriate positions on the work cloth 13. In the sewing machine 1, even if a recognized point is not on either the reference line 51 or 52, the position of the recognized point (the reference point) may be corrected to be on at least one of the reference lines. Therefore, the recognized points may be appropriately used for generating data of a reference plane.

The second data generating processing will be explained. Unlike in the case of the first data generating processing, embroidery data is generated based on the shape of a parallelogram in the second data generating processing. In the following explanation, the same step numbers are respectively allocated to steps of the processing that are the same as in the first data generating processing, and an explanation of those same steps is omitted or simplified.

The user may specify three points on the work cloth 13 and input a command to the sewing machine 1 to perform the second data generating processing. When the command to perform the second data generating processing is input, the CPU 61 of the sewing machine 1 starts the second data generating processing shown in FIG. 14. In the second data generating processing, first, an image of the work cloth 13 is captured by the image sensor 50 (step S1). The reference line setting screen, which includes the captured image of the work cloth 13, is displayed on the liquid crystal display 10 (step S2). Next, third reference line setting processing is performed (step S60).

Figure 15:
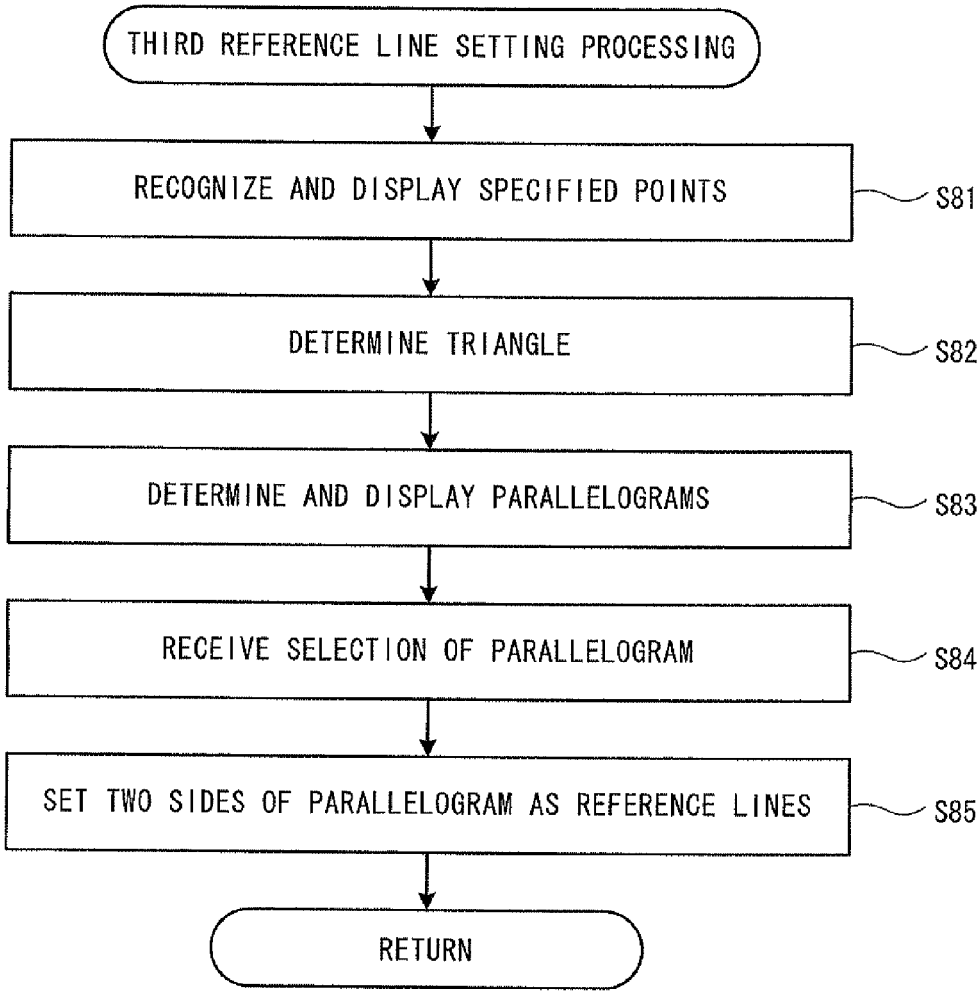
FIG. 15 is a flowchart of third reference line setting processing that is performed in the second data generating processing.
Figure 16:
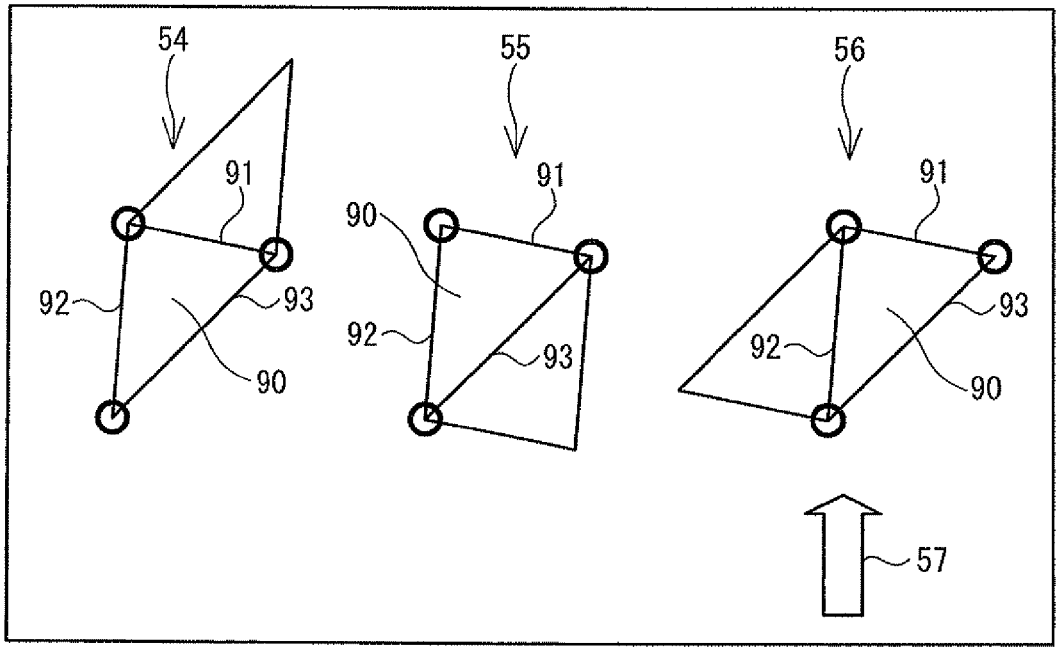
FIG. 16 is a figure that shows an example of a screen of a liquid crystal display on which three parallelograms are displayed.

As shown in FIG. 15, in the third reference line setting processing, the positions of the three points specified on the work cloth 13 are recognized by image processing. The recognized positions are set as positions of reference points. The captured image and the reference points are displayed on the liquid crystal display 10 (step S81). A triangle is determined using the three reference points as the vertices (step S82). Three parallelograms are determined in which one of the three sides of the determined triangle is a diagonal line and each of the remaining two sides of the triangle is one of opposite sides. As shown in FIG. 16, three determined parallelograms 54 to 56 are displayed on the liquid crystal display 10 (step S83). For the parallelogram 54, a first side 91 of a triangle 90 is a diagonal line and each of a second side 92 and a third side 93 of the triangle 90 is one of opposite sides. Similarly, a third side 93 and a second side 92 are diagonal lines for the parallelograms 55 and 56, respectively.

Next, a selection of a parallelogram is received (step S84). While viewing an arrow 57 displayed on the liquid crystal display 10, the user may operate the touch panel 16 to select a desired one of the three parallelograms 54 to 56. Of the four sides of the selected parallelogram, the CPU 61 extracts two adjacent sides, and sets straight lines that are extended lines of the extracted two sides as the reference lines (step S85). The processing returns to the second data generating processing (refer to FIG. 14).

Figure 14:
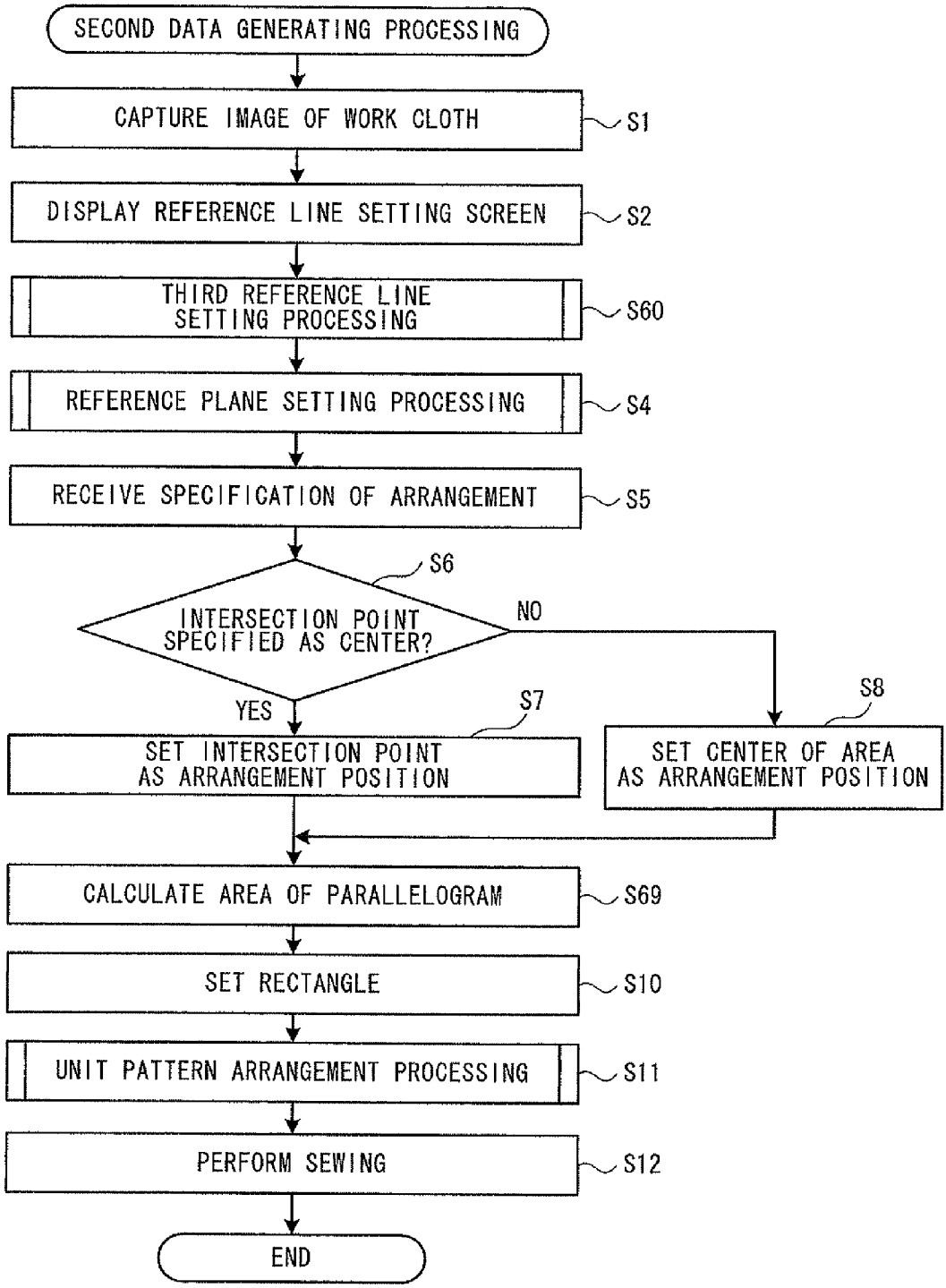
FIG. 14 is a flowchart of second data generating processing performed by the sewing machine.

As shown in FIG. 14, when the third reference line setting processing (step S60) is ended, the reference plane setting processing is performed (step S4). In the reference plane setting processing, a reference plane is set based on the two reference lines and the three reference points. Specifically, the reference plane is set by setting a plurality of straight lines such that an interval between the straight lines is a distance between two reference points on one of the reference lines, namely, a length of a side of the selected parallelogram. In the reference plane setting processing at step S4 shown in FIG. 14, the processing is performed in the same manner as the reference plane setting processing shown in FIG. 6 and described above. Next, a specification of an arrangement of the unit patterns is received (step S5). In a case where the first arrangement is selected (YES at step S6), the intersecting points of the straight lines on the reference plane are set as the arrangement positions of the centers of the unit patterns (step S7). In a case where the second arrangement is selected (NO at step S6), the center points of the areas enclosed by the straight lines are set as the arrangement positions of the centers of the unit patterns (step S8). Next, an area of a parallelogram is calculated in which a distance between the reference points on each of the two reference lines is a length of opposite sides in each of the two directions (step S69). One of rectangular areas that fit in the area of the parallelogram is set as an area in which the unit pattern will be sewn (step S10). The unit pattern arrangement processing explained above (refer to FIG. 9) is performed and the embroidery data is generated (step S11). An embroidery pattern is sewn on the work cloth 13 based on the generated embroidery data (step S12). The processing then ends.

As described above, when a command is issued to the sewing machine 1 to perform the second data generating processing, the sewing machine 1 may generate data of a reference plane based on a selected one of the three parallelograms. The selected parallelogram is formed in a plurality on the reference plane. As a result, the user may cause the sewing machine 1 to generate embroidery data while accurately ascertaining the shape of the area of the parallelogram in which a unit pattern will be arranged.

The embroidery data processing apparatus and the storage medium of the present disclosure are not limited to the embodiment that is described above, and various types of modifications may be made. For example, in the above-described embodiment, the embroidery data for sewing the plurality of unit patterns is generated by the sewing machine 1. However, the above-described embroidery data generating processing may be performed in another device such as a known personal computer or the like. In the above-described embodiment, programs that are executed by the CPU 61 to perform various types of processing are stored in the ROM 62. However, the programs may be stored in another storage medium such as the EEPROM 64, a CDROM, which is not shown in the drawings, or the like.

In the above-described embodiment, when the CPU 61 performs the second data generating processing to generate the embroidery data based on the shape of the parallelogram, the reference points are set by recognizing the positions of the points specified on the work cloth 13 by image processing. However, even in the second data generating processing, the CPU 61 may set the reference points in accordance with operation of the touch panel 16 or the like in the same manner as the processing at steps S21, S22, and S26 shown in FIG. 4.

In the above-described embodiment, in the reference plane setting processing (refer to FIG. 6), virtual reference points are set by copying all of the two or more reference points set on one of the reference lines, while maintaining the distances among all of the reference points from the reference point at one end to the reference point at the other end. For example, in a case where four reference points are set and the distances between adjacent reference points are 3, 1, 2 (cm) in order, the virtual reference points will be set by being placed at corresponding distances "3, 1, 2, 3, 1, 2, 3, 1, 2 . . . (cm)" in order. However, it is not necessary to set the virtual reference points based on the distances among all of the set reference points. For example, the user may select two or more reference points from among the three or more reference points that have been set. Then, the virtual reference points may be set by copying only the selected reference points with regularity.

In the above-described embodiment, the selection of a unit pattern (refer to step S41 in FIG. 9) and the selection of a parallelogram (refer to step S84 in FIG. 15) are performed in accordance with the operation of the touch panel 16 by the user. However, the CPU 61 may select the unit pattern or the parallelogram without being based on an operation by the user. For example, the CPU 61 may randomly select the unit pattern or the parallelogram.

In the above-described embodiment, when a command is issued to set the straight lines on the reference plane as the boundaries of the unit patterns, the CPU 61 determines the arrangement positions of the centers of the unit patterns to be the centers of the parallelograms formed by the straight lines. However, the centers of the parallelograms may not be the arrangement positions of the centers of the unit patterns. In other words, as long as the unit patterns to be arranged do not overlap with the straight lines, the CPU 61 may freely determine the arrangement positions of the unit patterns. The CPU 61 may change the size of the unit patterns to be arranged, in accordance with the size of the area of each of the parallelograms in which the unit patterns will be arranged.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data processing apparatus that is configured to process embroidery data for sewing an embroidery pattern including a plurality of unit patterns arranged on a work cloth using a sewing machine, the sewing machine being configured to perform embroidery sewing, the embroidery data processing apparatus comprising:

a reference point setting unit that is configured to set, within a sewing area, positions of at least three reference points to be used to determine a plurality of arrangement positions of the plurality of unit patterns, the sewing area being an area in which sewing can be performed;

a reference line setting unit that is configured to set two reference lines, the two reference lines being straight lines that intersect each other, and each of the reference lines passing through at least two reference points of the at least three reference points;

a plane setting unit that is configured to set a reference plane by setting two sets of a plurality of virtual lines arranged in a matrix, each set of the plurality of virtual lines being arranged based on a distance between at least two reference points through which one of the two reference lines passes and being parallel to the other of the two reference lines, the reference plane being a plane on which the plurality of unit patterns are to be arranged, and the one of the two reference lines being different for each of the two sets of plurality of virtual lines;

a position determination unit that is configured to determine the plurality of arrangement positions based on the reference plane;

a pattern selection unit that is configured to select a type for the plurality of unit patterns from at least one type of unit pattern for which embroidery data is stored in a memory; and an arrangement unit that is configured to arrange the plurality of unit patterns of the type selected by the pattern selection unit in the plurality of arrangement positions determined by the position determination unit.

2. The embroidery data processing apparatus according to claim 1, wherein the plane setting unit sets two sets of a plurality of virtual points arranged with regularity, each set of the plurality of virtual points being arranged on each of the two reference lines based on the distance, and sets the reference plane by setting the two sets of the plurality of virtual lines such that each set of the plurality of virtual lines respectively pass through the at least two reference points and the plurality of virtual points on one of the two reference lines and are parallel to the other of the two reference lines.

3. The embroidery data processing apparatus according to claim 2, wherein the reference point setting unit is configured to set an additional reference point on at least one of the two reference lines which passes through at least two reference points of the at least three reference points.

4. The embroidery data processing apparatus according to claim 2, further comprising:

a position correction unit that is configured to correct a position of at least one of the at least three reference points on at least one of the two reference lines in a case where the at least one of the at least three reference points is not on either one of the two reference lines.

5. The embroidery data processing apparatus according to claim 1, further comprising:

a triangle determination unit that is configured to determine a triangle whose vertices are three of the at least three reference points;

a parallelogram determination unit that is configured to determine three parallelograms based on the triangle determined by the triangle determination unit, each of the three parallelograms having one side of three sides of the triangle as a diagonal line and the other two sides of the triangle as two adjacent sides, and the one side of the triangle being different for each of the three parallelograms; and a shape selection unit that is configured to select one of the three parallelograms determined by the parallelogram determination unit;

wherein in a case where one of the three parallelograms is selected by the shape selection unit, the reference line setting unit, of three straight lines that respectively overlap with the three sides of the triangle, sets as the reference lines two straight lines that overlap with two adjacent sides of the selected parallelogram, and the plane setting unit sets the reference plane by taking a length of one side of the selected parallelogram as each of intervals between one of the two sets of the plurality of virtual lines on the reference plane that extend in a direction that intersects with the one side of the selected parallelogram and a length of another side adjacent to the one side of the selected parallelogram as each of intervals between the other set of the plurality of virtual lines that extend in a direction that intersects with the other side of the selected parallelogram.

6. The embroidery data processing apparatus according to claim 1, wherein the position determination unit determines the plurality of arrangement positions of the plurality of unit patterns by setting intersection points of the plurality of virtual lines on the reference plane as center positions of the plurality of unit patterns.

7. The embroidery data processing apparatus according to claim 1, wherein the position determination unit determines the plurality of arrangement positions of the plurality of unit patterns by setting the plurality of virtual lines on the reference plane as boundaries of areas in which the plurality of unit patterns are respectively arranged.

8. The embroidery data processing apparatus according to claim 1, further comprising:

an area setting unit that is configured to set a sewing target area within the sewing area, the sewing target area being an area on which the plurality of unit patterns will be sewn; and an arrangement determination unit that is configured to determine whether each of the plurality of unit patterns fits within the sewing target area in a case where the plurality of unit patterns are respectively arranged in the plurality of arrangement positions determined by the position determination unit;

wherein the arrangement unit arranges, of the plurality of unit patterns, a unit pattern that is determined by the arrangement determination unit to fit within the sewing target area in corresponding one of the plurality of arrangement positions.

9. The embroidery data processing apparatus according to claim 1, wherein the reference point setting unit is configured to set, in accordance with an operation of an operation unit by a user, the positions of the at least three reference points inside the sewing area on the work cloth whose image is displayed on a display.

10. The embroidery data processing apparatus according to claim 1, wherein the reference point setting unit is configured to recognize positions of at least three points specified on the work cloth based on image data of the work cloth that has been captured by an image capturing unit, and sets the recognized positions of the at least three points as the positions of the at least three reference points.

11. A computer-readable medium storing an embroidery data processing program for processing embroidery data for sewing an embroidery pattern including a plurality of unit patterns arranged on a work cloth, the program comprising instructions that cause a computer to perform the steps of:

setting, within a sewing area, positions of at least three reference points to be used to determine a plurality of arrangement positions of the plurality of unit patterns, the sewing area being an area in which sewing can be performed;

setting two reference lines, the two reference lines being straight lines that intersect each other, and each of the reference lines passing through at least two reference points of the at least three reference points;

setting a reference plane by setting two sets of a plurality of virtual lines arranged in a matrix, each set of the plurality of virtual lines being arranged based on a distance between at least two reference points through which one of the two reference lines passes and being parallel to the other of the two reference lines, the reference plane being a plane on which the plurality of unit patterns are to be arranged, and the one of the two reference lines being different for each of the two sets of plurality of virtual lines;

determining the plurality of arrangement positions based on the reference plane;

selecting a type for the plurality of unit patterns from at least one type of unit pattern for which embroidery data is stored in a memory; and arranging the plurality of unit patterns of the selected type in the determined plurality of arrangement positions.

12. The computer-readable medium according to claim 11, wherein the step of setting the reference plane includes the steps of:

setting two sets of a plurality of virtual points arranged with regularity, each set of the plurality of virtual points being arranged on each of the two reference lines based on the distance; and setting the reference plane by setting the two sets of the plurality of virtual lines such that each set of the plurality of virtual lines respectively pass through the at least two reference points and the plurality of virtual points on one of the two reference lines and are parallel to the other of the two reference lines.

13. The computer-readable medium according to claim 12, wherein the program further comprises instructions that cause the computer to perform the step of:

setting an additional reference point on at least one of the two reference lines which passes through at least two reference points of the at least three reference points.

14. The computer-readable medium according to claim 12, wherein the program further comprises instructions that cause the computer to perform the step of correcting a position of at least one of the at least three reference points on at least one of the two reference lines in a case where the at least one of the at least three reference points is not on either one of the two reference lines.

15. The computer-readable medium according to claim 11, wherein:

the program further comprises instructions that cause the computer to perform the steps of:

determining a triangle whose vertices are three of the at least three reference points;

determining three parallelograms based on the determined triangle, each of the three parallelograms having one side of three sides of the triangle as a diagonal line and the other two sides of the triangle as two adjacent sides, and the one side of the triangle being different for each of the three parallelograms; and selecting one of the determined three parallelograms, and in a case where one of the three parallelograms is selected, of three straight lines that respectively overlap with the three sides of the triangle, two straight lines that overlap with two adjacent sides of the selected parallelogram are set as the reference lines, and the reference plane is set by taking a length of one side of the selected parallelogram as each of intervals between one of the two sets of the plurality of virtual lines on the reference plane that extend in a direction that intersects with the one side of the selected parallelogram and a length of another side adjacent to the one side of the selected parallelogram as each of intervals between the other set of the plurality of virtual lines that extend in a direction that intersects with the other side of the selected parallelogram.

16. The computer-readable medium according to claim 11, wherein the step of determining the plurality of arrangement positions of the plurality of unit patterns is performed by setting intersection points of the plurality of virtual lines on the reference plane as center positions of the plurality of unit patterns.

17. The computer-readable medium according to claim 11, wherein the step of determining the plurality of arrangement positions of the plurality of unit patterns is performed by setting the plurality of virtual lines on the reference plane as boundaries of areas in which the plurality of unit patterns are respectively arranged.

18. The computer-readable medium according to claim 11, wherein:

the program further comprises instructions that cause the computer to perform the steps of:

setting a sewing target area within the sewing area, the sewing target area being an area on which the plurality of unit patterns will be sewn; and determining whether each of the plurality of unit patterns fits within the sewing target area in a case where the plurality of unit patterns are respectively arranged in the determined plurality of arrangement positions, and of the plurality of unit patterns, a unit pattern that is determined to fit within the sewing target area is arranged in corresponding one of the plurality of arrangement positions.

19. The computer-readable medium according to claim 11, wherein the step of setting the positions of the at least three reference points is performed, in accordance with an operation of an operation unit by a user, inside the sewing area on the work cloth whose image is displayed on a display.

20. The computer-readable medium according to claim 11, wherein the program further comprises instructions that cause the computer to perform the steps of:

recognizing positions of at least three points specified on the work cloth based on image data of the work cloth that has been captured by an image capturing unit, and setting the recognized positions of the at least three points as the positions of the at least three reference points.

* * * * *